US005749329A

United States Patent [19]

Thurfjell

[11] Patent Number: 5,749,329

[45] Date of Patent: May 12, 1998

[54] HEAT-STORAGE DEVICE

[76] Inventor: Jens Thurfjell, Vastra Varvsgatan 24 A, S-972 36 Lulea, Sweden

[21] Appl. No.: 836,580

[22] PCT Filed: Oct. 13, 1995

[86] PCT No.: PCT/SE95/01188

§ 371 Date: Jun. 16, 1997

§ 102(e) Date: Jun. 16, 1997

[87] PCT Pub. No.: WO96/15365

PCT Pub. Date: May 23, 1996

[30] Foreign Application Priority Data

Nov. 14, 1994 [SE] Sweden ..... 9403907
Mar. 20, 1995 [SE] Sweden ..... 9500964

[51] Int. Cl.[6] ..... F01P 11/20

[52] U.S. Cl. ..... 123/41.14; 123/142.5 R

[58] Field of Search ..... 123/41.14, 142.5 R, 123/142.5 E

[56] References Cited

U.S. PATENT DOCUMENTS

| | | | |
|---|---|---|---|
| 2,401,510 | 6/1946 | Rowley | 123/41.14 |
| 3,853,270 | 12/1974 | Prebil | 123/41.14 |
| 4,556,171 | 12/1985 | Fukami et al. | 123/41.14 |
| 5,435,277 | 7/1995 | Takahashi | 123/41.14 |
| 5,662,072 | 9/1997 | Suzuki et al. | 123/41.14 |

FOREIGN PATENT DOCUMENTS

| | | | |
|---|---|---|---|
| 58-133415 | 8/1983 | Japan | 123/41.14 |
| 6-213116 | 8/1994 | Japan | 123/41.14 |
| 415629 | 8/1934 | United Kingdom | 123/41.14 |

*Primary Examiner*—Erick R. Solis
*Attorney, Agent, or Firm*—Young & Thompson

[57] ABSTRACT

The present invention relates to a heat-storage device for a liquid-cooled internal combustion engine and intended for heating the engine prior to starting the same, wherein the engine block (2) has a coolant pump (3) and coolant circulating passageways, wherein the heat-storage device includes a thermally-insulated storage container (7) for storing heated coolant, a reciprocatingly movable plunger means (9) mounted in the container (7) and functioning to divide the container into two chambers (8, 8') which are connected with the inlet and outlet of the engine-block coolant passageways, and a pump (10) by means of which coolant can be passed from the engine-block passageways to the storage container (7), wherein the two chambers (8, 8') can be placed in flowcommunication with one another through the medium of at least one valve means (19) provided in the movable plunger means.

6 Claims, 1 Drawing Sheet

HEAT-STORAGE DEVICE

The present invention relates to a heat-storage device of the kind defined in the preamble of claim 1.

The problems of cold-starting internal combustion engines, such as the engines of automotive vehicles, are generally known. These problems are normally overcome by connecting the engine to a separate heat source, such as an electric engine heater for instance, before starting the engine. Devices which avail themselves of the heat content of coolant that has been heated by the engine, by storing the liquid in an insulated container that is able to communicate with the engine-cooling system have also been proposed. However, special requirements are placed on such devices when they are intended for use in more modern internal combustion engines that include so-called closed cooling systems which operate with a continuous coolant volume.

One example of a device intended for this purpose is described in Swedish Patent Specification SE-B-444 348, this device representing the technology on which the present invention is based in accordance with the preamble of claim 1. This patent specification describes an arrangement relating to liquid-cooled internal combustion engines whose engine blocks are provided with passageways for the circulation of water coolant, including a heat-insulated storage container for storing hot coolant, a reversible pump by means of which the coolant can be pumped from the passageways in the engine block to the heat-insulated storage container and from there back to the passageways in the engine block, wherein the storage container is divided into two chambers with the aid of a reciprocatingly movable plunger means, and wherein the chambers communicate with inlet and outlet orifices of the engine block coolant passageways. In the case of this embodiment, one chamber in the storage container contains cold coolant when the engine is running. When the engine is stopped, hot coolant is pumped into the other chamber, therewith displacing the plunger and leading the cold coolant to the passageways in the engine block. Before restarting the engine, the pump is activated, although now in the opposite direction, so as to lead the stored hot coolant from said other chamber to the passageways in the engine block while leading cold coolant from the engine block to the first-mentioned chamber at the same time.

This problem solution has certain drawbacks. Firstly, the storage container is cooled when one chamber thereof is emptied of its hot coolant contents through the medium of the movable plunger means and cold coolant is successively led from the engine into the other chamber of the storage device, i.e. cold coolant is stored in the container as the motor is running. Thus, when the engine is stopped the hot coolant passed from the engine block to the container will be stored in a chamber which has been cooled by the cold coolant, thereby greatly reducing the efficiency of the arrangement. Secondly, the arrangement requires the presence of a reversible pump.

Accordingly, an object of the present invention is to provide a heat-storage device which includes an insulated storage container whose temperature is equivalent to the temperature of the coolant during running of the engine, and which only requires the presence of a single-acting pump. In other words, the object of the invention is to provide a heat-storage device which enables hot coolant to flow through the storage device with the intention of heating the same, as the engine is running. In this regard, it is also essential that the coolant normally remaining in the conduit is passed to the engine, so as to completely empty the container of all coolant.

It has not been possible to achieve these inventive objects with the earlier known heat-storage arrangements pertaining to water cooled internal combustion engines. The objects are, however, achieved in accordance with the invention, with the aid of a heat-storage device having the features set forth in the following claims.

The invention will now be described in more detail with reference to a non-limiting embodiment thereof and also with reference to the accompanying drawings, in which

Figure 1:
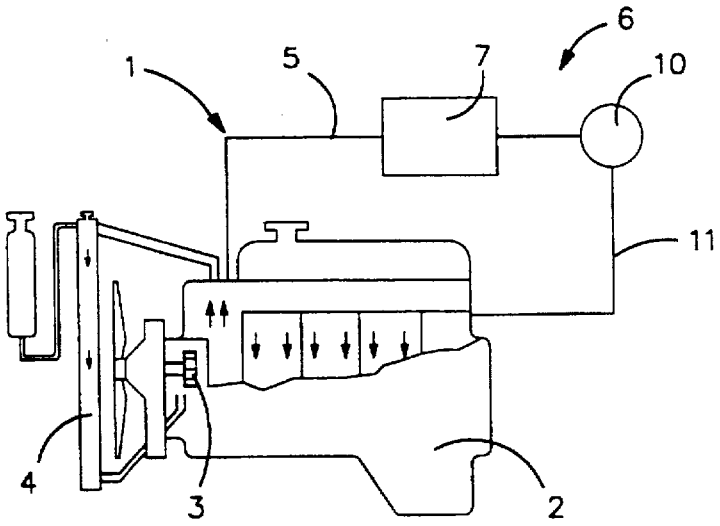
FIG. 1 is a partially sectioned schematic illustration of a water cooled internal combustion engine fitted with an inventive heat-storage device.

Turning to the drawing, the reference numeral 1 identifies generally a water cooled internal combustion engine whose engine block 2 contains a coolant pump 3 and coolant circulating passageways (not shown in detail), said coolant also being passed through an air-cooled heat-exchanger 4, a so-called radiator.

One end of respective coolant passageways in the engine block 2 is connected to an inventive heat-storage device 6 by means of a conduit 5. The heat-storage device 6 includes an insulated storage container 7 having a first chamber 8 which is delimited from a second chamber 8 by means of a reciprocatingly movable plunger means 9. The second chamber 8' is connected to a pump 10 which, in turn, is connected to the other end of respective coolant passageways in the engine block 2, by means of a further conduit 11.

Figure 2:
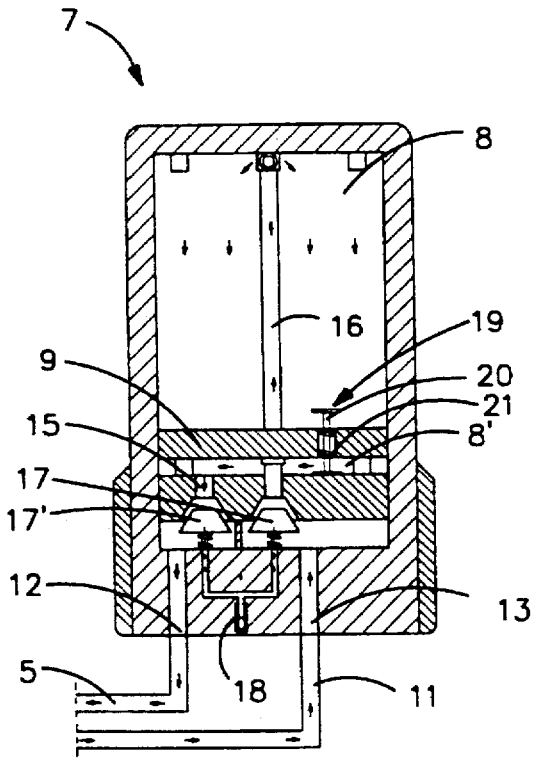
FIG. 2 is a longitudinal sectional view of the heat-storage device, through which hot coolant flows while the engine is running.
Figure 3:
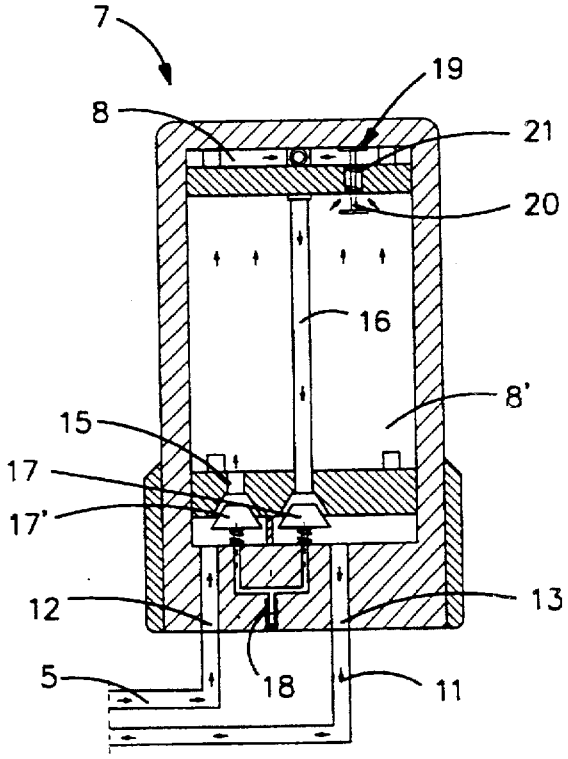
FIG. 3 is a longitudinal sectional view of the heat-storage device, wherein stored coolant is passed to the engine.

As will be seen from FIGS. 2 and 3, in the case of the illustrated embodiment the inlet and outlet orifices of the storage container are placed at one end of said container and extend to a respective space or cavity through the medium of respective bores 12 and 13. These cavities or spaces can be placed in communication with the first and second chamber of the storage container 7 respectively, through the medium of channels 15 and 16 provided with insulating closure means 17, 17'.

One of said channels 16 has the form of a tube disposed roughly in the centre of the container and extending essentially through the entire length thereof. This tube also forms a guide for the reciprocatingly movable plunger means 9.

Each of the closure means 17, 17' has the form of a valve cone and can be moved simultaneously between an open and a closed position by means of an electromagnetic device 18.

The first and the second chambers 8, 8' of the storage container 7 can be placed in communication with one another through the medium of a flow connection. This flow connection includes at least one valve means 19 arranged in the plunger means 9 and controlled between an open position and a closed position in accordance with the position of the plunger means 9 in relation to the end-walls of the storage container 7, said end-walls forming axial plunger-means abutments. The valve means 19 is designed to be closed when the plunger means 9 is spaced from the end-walls of the storage container and to be open when the plunger means, and consequently also the valve means 19, approach and come into abutment with one of the end-walls of the container 7.

Many different embodiments of such valve means are known to the art, and in the case of the illustrated embodiment of the invention the valve means comprises a valve slide 20 having a part which projects out from each end of the valve means 9, wherein the valve slide is biassed towards a valve closing position by spring means 21. When one of the outwardly projecting parts of the valve slide 20 is subjected to a force sufficiently strong to overcome the force of the spring 21, the valve will open so as to permit coolant to flow through the plunger means 9 and thus through the storage container 7. Practical tests have shown that the force at which the movable plunger means 9 is driven towards one of the end-walls of the storage container 7, by virtue of the force generated by the coolant flow and the relative pressure difference thus occurring between the container chambers 8 and 8', is sufficient for the valve slide 20 to adopt a valve open position when in abutment with the end-wall and with an appropriately chosen spring characteristic. When the effect generated by the coolant flow ceases and the pressure differences on each side of the plunger means 9 are thus equalized, the spring will drive the plunger means away from the end-wall and the valve slide 20 will take a valve closing position.

The water coolant in the passageways of the engine block 2 is heated while the engine 1 is running. In addition to causing the coolant to circulate to the engine heat-exchanger 4 and the engine block 2, the engine coolant pump 3 also causes the coolant to circulate through the heat-storage device 6.

When the engine is running, the movable plunger means 9 is located in its bottom end position in abutment with the end-wall (see FIG. 2), wherewith the valve-slide 20 is located in its valve open position. The engine coolant pump 3 causes the coolant to circulate through the storage container 7 and through the pump 10, which is not activated hereby.

The coolant circulating to the storage container 7 is first led into the first chamber in said container and then to the second chamber 8' via the valve slide 20. The coolant then passes through the pump 10 and back to the engine block 2, through the conduit 11.

The internal walls of the storage container 7 are herewith heated continuously to a temperature which is equal to the coolant temperature during running of the engine 1.

When the engine 1 is switched off, causing the engine coolant pump 3 to stop, the pressure increase on one side of the plunger means 9 will also fall off and the valve slide 20 consequently closed.

In order to prevent an exchange of heat between the hot coolant stored in the insulated storage container 7 and the coolant which is located outside the container 7 and which cools progressively when the engine 1 is switched off, the movable plunger means 9 is appropriately insulating. In order to further avoid the risk of an exchange of heat between the hot coolant in the container 7 and the subsequently cooled coolant outside said container, the closure means 17, 17' of the heat-storage device are also appropriately heat-insulating.

Prior to restarting the engine, the pump 10 is activated first, so that cooled coolant is pumped from the engine and passed from the other end of the engine block 2 and into the second chamber 8' of the storage container 7, i.e. in towards the movable plunger means 9, whose valve slide 20 is herewith in a valve-closing position. The movable plunger means is moved upwards (FIG. 3) under the influence of the force exerted by the coolant flow and the relative increase in pressure on one side of the plunger means, so that coolant stored in the first chamber 8 will be led to one end of the engine block 2 through the conduit 5, while cooled coolant is led from the engine block 2 into the second chamber 8', therewith gradually filling said second chamber.

As the movable plunger means 9 approaches the upper end-wall of the storage container 7, the outwardly projecting part of the valve slide 20 will come into contact with the end-wall and therewith take a valve open position. However, the pump 10 is not stopped in this position of the valve slide, but continues to operate until the conduit 5 connected to the coolant passageways in the engine block 2 has also been emptied of hot, stored coolant. As a result, the engine block coolant is replaced essentially by the hot coolant stored in the storage container 7, whereafter the engine is ready to be started-up.

When starting-up the engine 1, the engine pump 3 pumps the coolant in the reverse direction, i.e. into the first chamber 8 of the storage container 7, wherewith the coolant flow moves the movable plunger means 9 back to its bottom end position (FIG. 2) in contact with the end-wall, wherewith the valve slide 20 is open and coolant is again allowed to circulate through the storage container 7.

The motor of the pump 10 can be controlled with the aid of known means, for instance by means of end-position switches which are activated in accordance with the position of the plunger means 9 in the storage container 7, and control means which function to stop the pump 10 after a predetermined period of time has lapsed. Naturally, temperature sensors can be provided at appropriate locations, with the intention of preventing the device being activated unnecessarily, for instance when the engine to be started-up is already at the requisite running temperature. All of the signals produced by the sensing means are preferably coordinated with a microprocessor.

Because the two chambers 8, 8' of the storage container can be placed in flow-communication with one another through the medium of the valve slide 20, the inventive heat-storage device also provides the advantage of enabling the driver and the passengers of the vehicle to use the stored heat to heat the interior of the vehicle with the aid of the heat-exchanger arranged in the vehicle interior, when the engine 1 is stopped. In practice, this enables the interior of a parked vehicle with the engine stopped to be kept warm, by activating the pump 10 and therewith causing hot, stored coolant to circulate through the heat-exchanger provided in the vehicle interior. To enable the interior of a vehicle to be kept warm for the comfort of the driver and passengers in the case of relatively long-term parking, a heating element may be installed in a suitable place in the storage container 7, such that activation of the pump 10 will result in coolant flowing past the heating element and therewith heating the vehicle interior.

The inventive heat-storage device also has the advantage of allowing several storage containers to be mutually connected in series when necessary, wherein all of said containers can be driven by means of one single pump. As will be understood, this is made possible by the fact that the two chambers can be placed in flow-communication with one another by means of the valve means 19 provided in the plunger means, this valve means enabling coolant to flow through the storage container 7.

It will also be understood that the inventive device can be used in areas other than that described and illustrated in the drawing, such as for coolant storage and room-attemperating purposes, for instance.

I claim:

1. A heat-storage device pertaining to a liquid-cooled internal combustion engine and intended for heating the engine prior to starting the engine, wherein the engine block (2) has a coolant pump (3) and coolant circulating passageways, wherein the heat-storage device includes a thermally-insulated storage container (7) for storing heated coolant, a reciprocatingly movable plunger means (9) mounted in the container (7) and functioning to divide said container into two chambers (8, 8') which are connected with the inlet and outlet of the engine-block coolant passageways, and a pump (10) by means of which coolant can be passed from the engine-block passageways to the storage container (7), characterized in that the two chambers (8, 8') can be placed in flow-communication with one another through the medium of at least one valve means (19) provided in the movable plunger means (9), so as to enable coolant to flow through the storage container (7) while the engine (1) is running; and in that the pump (10) functions in a known manner to pump coolant into one (8') of the storage container chambers (8, 8') in a direction opposite to the flow direction of the engine coolant prior to starting-up the engine, the valve means (19) in the movable plunger means (9) being closed.

2. A device according to claim 1, characterized in that the valve means (19) is constructed so as to be open when coming into abutting contact with an end-wall of the container (7) and to be closed when the plunger means (9) moves out of abutment with an end-wall towards the opposite end-wall.

3. A device according to claim 2, characterized in that the valve means (19) includes a valve slide having a part which projects out from each end of the plunger means, wherein the valve slide (20) is biassed towards a valve-closing position by spring means (21), and wherein the valve slide is caused to take a valve-open position as an outwardly projecting part comes into abutment with one of the container end-walls.

4. A device according to claim 1, characterized in that the movable plunger means (9) is thermally insulated.

5. A device according to claim 2, characterized in that the movable plunger means (9) is thermally insulated.

6. A device according to claim 3, characterized in that the movable plunger means (9) is thermally insulated.

* * * * *